US007553083B2

(12) United States Patent
Plourde

(10) Patent No.: US 7,553,083 B2
(45) **Date of Patent: *Jun. 30, 2009**

(54) RECLOSABLE PACKAGES WITH FRONT PANEL OPENING

(75) Inventor: Eric Paul Plourde, Homewood, IL (US)

(73) Assignee: Illinois Tool Works Inc., Glenview, IL (US)

( * ) Notice: Subject to any disclaimer, the term of this patent is extended or adjusted under 35 U.S.C. 154(b) by 689 days.

This patent is subject to a terminal disclaimer.

(21) Appl. No.: 11/081,132

(22) Filed: Mar. 15, 2005

(65) Prior Publication Data

US 2006/0210202 A1 Sep. 21, 2006

(51) Int. Cl.
*B65D 33/00* (2006.01)
*B65D 33/16* (2006.01)

(52) U.S. Cl. ..... 383/203; 383/210; 383/210.1; 383/61.2; 383/63; 383/66

(58) Field of Classification Search ..... 383/66, 383/63, 61.2, 210, 210.1, 203
See application file for complete search history.

(56) References Cited

U.S. PATENT DOCUMENTS 5,425,216 A * 6/1995 Ausnit ..... 53/410
5,461,845 A 10/1995 Yeager
5,672,009 A * 9/1997 Malin ..... 383/204
5,782,733 A 7/1998 Yeager
5,806,984 A 9/1998 Yeager
5,823,933 A 10/1998 Yeager
5,902,047 A 5/1999 Yeager
5,951,453 A * 9/1999 Yeager ..... 493/213
5,954,433 A 9/1999 Yeager
6,000,197 A * 12/1999 Ausnit ..... 53/412
6,019,512 A 2/2000 Yeager
6,079,878 A 6/2000 Yeager
6,177,172 B1 1/2001 Yeager
6,224,262 B1 4/2001 Hogan et al.
6,264,366 B1 * 7/2001 Custer ..... 383/5
6,270,257 B1 8/2001 Yeager
6,402,376 B1 * 6/2002 Bois ..... 383/64
6,481,891 B2 11/2002 Yeager
6,659,643 B2 * 12/2003 Plourde et al. ..... 383/61.2
6,960,021 B2 * 11/2005 Schneider et al. ..... 383/64
6,991,372 B2 * 1/2006 Cornelisse ..... 383/64
7,094,455 B2 * 8/2006 Johnson et al. ..... 428/40.1
2006/0159372 A1 * 7/2006 Plourde et al. ..... 383/66

* cited by examiner

*Primary Examiner*—Jes F Pascua
(74) *Attorney, Agent, or Firm*—Ostrager Chong Flaherty & Broitman P.C.

(57) ABSTRACT

A reclosable package comprising front and rear panels extending between top and bottom transverse seals, the front panel having a line or lines of weakened tear resistance for forming an opening, through which a zipper can be accessed. The zipper is suspended from the top transverse seal and attached to the front panel at a lower elevation. At least a major portion of the base strip of a forward zipper part is disposed between the front panel and the base strip of a rearward zipper part. Respective upper portions of the zipper base strips are joined to each other in the top transverse seal. A lower portion of the base strip of the forward zipper part is joined to the front panel in a transverse band-shaped zone of joinder. No portion of the base strip of the rearward zipper part is joined to the rear panel outside of the top transverse seal.

3 Claims, 6 Drawing Sheets

RECLOSABLE PACKAGES WITH FRONT PANEL OPENING

BACKGROUND OF THE INVENTION

The present invention relates to methods and apparatus for making reclosable packages having a front panel opening.

In the automated manufacture of plastic reclosable packages or bags, it is known to feed a zipper assembly comprising interlocked zipper strips (formed by extrusion) to a position adjacent and transverse to a web of thermoplastic film and then attach one strip of the zipper assembly to the web by means of heat sealing. The zipper assemblies are attached at spaced intervals along the thermoplastic sheet, one zipper assembly being attached to each section of film respectively corresponding to an individual package or bag.

In accordance with one known method of feeding zipper assemblies to an automated form, fill and seal (FFS) machine, the zipper assembly is in the form of a tape that is unwound from a spool for automated feeding. The tape comprises a continuous length of interlocked fastener strips. The continuous tape is fed to a cutting device that cuts the tape at regular lengths to form an individual zipper. Each individual zipper is then transversely applied to a web of thermoplastic bag making film by heat sealing or other suitable means. The web carries the transversely applied zippers through the remaining stages of the FFS machine. Each individual zipper is incorporated into a respective package.

In many types of reclosable packages, the zipper is installed in a mouth located at the top of a receptacle. Typically this mouth is formed by the confronting top portions of front and rear panels of the receptacle. The zippered mouth of the package is oftentimes covered by a header that must be removed to gain access to the zipper.

In other types of bags, the zipper is attached to the interior surface of the front panel at an elevation below the top of the receptacle, with access to the zipper being provided via a front panel opening. The front panel opening is made by removing a portion of the front panel along a line of weakened tear resistance. One such reclosable package is disclosed in U.S. Pat. No. 5,951,453. As seen in FIG. 3 of U.S. Pat. No. 5,951,453, one zipper strip is attached to the inside surface of the front panel of the bag body, while the other zipper strip is attached to a lower marginal portion of a flange. An upper marginal portion of the flange is joined to the bag body at an upper or top seal. In accordance with one method of manufacture disclosed in U.S. Pat. No. 5,951,453, single zippers are transversely applied to a film web, one zipper per package length. The film web then carries the zippers through various stages of an FFS or packaging machine. In accordance with another disclosed method of manufacture, shown in FIGS. 6-8 of U.S. Pat. No. 5,951,453, double zippers having a common flange are transversely applied to a film web, one double zipper per a length of film for making two packages connected at their tops.

There is a need for alternative designs of reclosable packages of the type having a front panel opening, as well as methods for automated manufacture of such reclosable packages.

BRIEF DESCRIPTION OF THE INVENTION

The present invention is directed to reclosable packages of the type having a front panel opening and to methods for automated manufacture of such reclosable packages. Preferred embodiments of the invention will be disclosed with reference to a VFFS machine, but the methods disclosed herein also have application, for example, horizontal flow wrappers and pouching machines.

One aspect of the invention is a reclosable package comprising: a sealed receptacle having an interior volume and comprising a top transverse seal, a bottom transverse seal, a front panel extending between the top and bottom transverse seals, and a rear panel connected to the front panel at opposing sides of the receptacle and extending between the top and bottom transverse seals; a mass of product occupying a portion of the interior volume of the receptacle; and a zipper comprising first and second zipper parts that are mutually engageable to close the zipper and mutually disengageable to open the zipper, the first zipper part comprising a first base strip and a first closure member connected to the first base strip and extending transversely, and the second zipper part comprising a second base strip and a second closure member connected to the second base strip and extending transversely, the second closure member being in engagement with the first closure member, and at least a major portion of the first base strip being disposed between the front panel and the second base strip, wherein respective upper portions of the first and second base strips are joined to each other and to the receptacle in the top transverse seal, a lower portion of the first base strip is joined to the front panel in a transverse band-shaped zone of joinder, and no portion of the second base strip is joined to the rear panel outside of the top transverse seal.

Another aspect of the invention is a reclosable package comprising: a sealed receptacle having an interior volume and comprising a top transverse seal, a bottom transverse seal, a front panel extending between the top and bottom transverse seals, and a rear panel connected to the front panel at opposing sides of the receptacle and extending between the top and bottom transverse seals; a mass of product occupying a portion of the interior volume of the receptacle; a zipper comprising first and second zipper parts that are mutually engageable to close the zipper and mutually disengageable to open the zipper, the first zipper part comprising a first closure member and a first base strip connected to the first closure member, and the second zipper part comprising a second closure member in engagement with the first closure member and a second base strip connected to the second closure member, the second base strip having a height greater than the height of the first base strip, at least a portion of the first base strip being disposed between the front panel and the second base strip; and a third base strip disposed between the front panel and the second base strip, a lower portion of the third base strip being joined to an upper portion of the first base strip by a transverse peel seal, wherein respective upper portions of the second and third base strips are joined to each other and to the receptacle in the top transverse seal, a lower portion of the first base strip is joined to the front panel in a transverse band-shaped zone of joinder, and no portion of the second base strip is joined to the rear panel outside of the top transverse seal.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
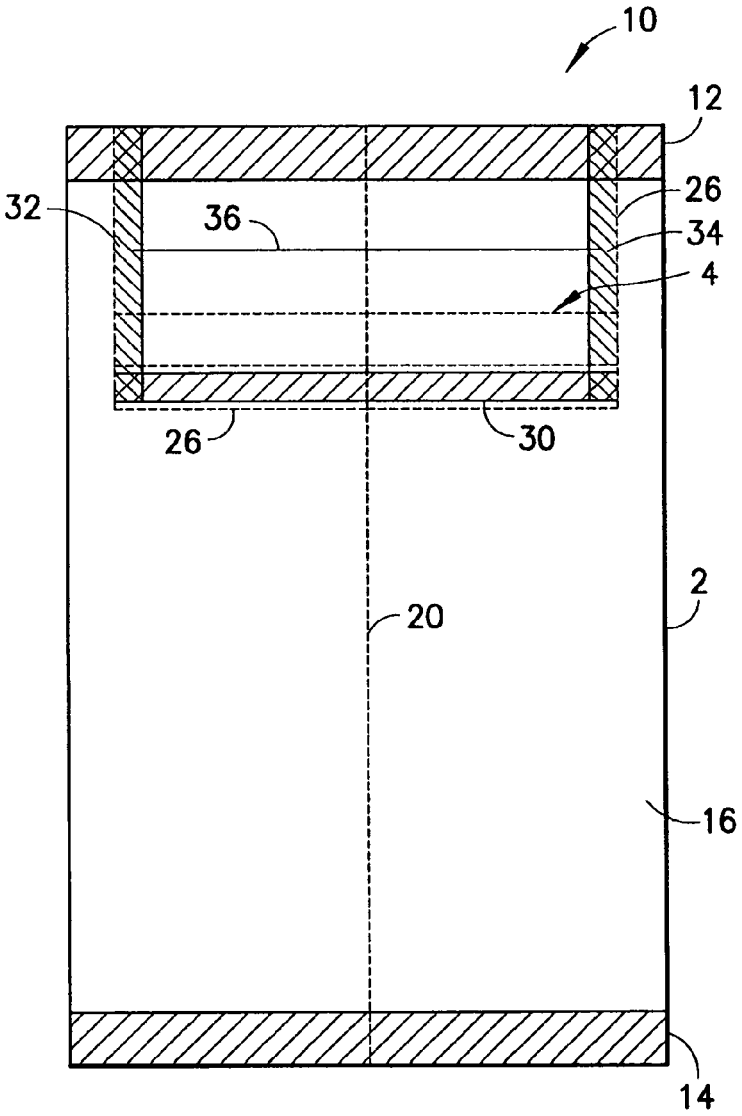
FIG. 1 is a drawing showing a front view of a reclosable package in accordance with a first embodiment of the invention. Transverse seals and zones of web/zipper joinder are indicated by hatching.
Figure 2:
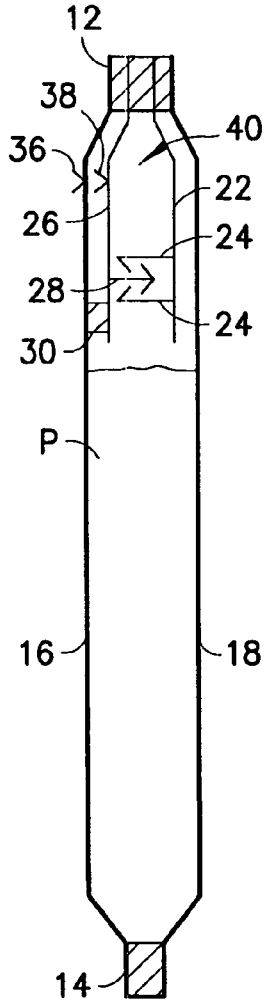
FIG. 2 is a drawing showing a sectional view of the reclosable package depicted in FIG. 1.

A reclosable package in accordance with a first embodiment of the invention is shown in FIGS. 1 and 2. This reclosable package 10 has a zipper and a front panel in which an opening or slit can be made, such opening or slit providing access to the zipper. The package 10 comprises a receptacle 2 filled with product P (see FIG. 2) and a reclosable feature in the form of an extruded plastic zipper 4 (whose closure profiles are outlined by dashed lines in FIG. 1) installed in the interior volume of the receptacle 2.

The receptacle 2 is made by folding and sealing a web of bag making material. The bag making material may be a monolayer made of thermoplastic film or paper or a laminate comprising two or more layers of thermoplastic material, a layer of paper coated with thermoplastic material or metallized thermoplastic film. In the examples disclosed herein, the bag making material is a web of thermoplastic film that has been folded and sealed to provide the receptacle structure depicted in FIGS. 1 and 2. The receptacle is constructed by wrapping the web of bag making material into a tube shape having overlapping marginal portions at the lateral edges of the web, and then sealing those overlapping marginal portions together to form a tube. That tube is later flattened and then sealed in respective transverse (mutually parallel) band-shaped zones to form top and bottom transverse seals 12 and 14 that enclose an interior volume of the receptacle. In the case wherein the zipper and receptacle are made of thermoplastic materials, the transverse seals 12 and 14 may be formed by conductive heat sealing, adhesive bonding, ultrasonic welding, or any other conventional technique for sealing thermoplastics. In a finished package, the interior volume of the receptacle is at least partially filled with a mass of product P (shown in FIG. 2).

As a result of the aforementioned transverse sealing, the receptacle 2 is configured to have a front panel 16 and a rear panel 18, which extend from the top transverse seal 12 to the bottom transverse seal 14 and are connected (not joined) to each other at the sides of the receptacle. The sides of the receptacle are formed by folding the web of bag making material. In the embodiment shown in FIG. 1, the front panel has no vertical seam, but the rear panel has a vertical seam, indicated by dashed line 20 in FIG. 1, along which two marginal portions of the web are sealed together to form a rear panel having two sections. As used herein, the terms "front panel" and "rear panel" respectively mean the portions of the web that are respectively visible from the front and rear of the package, which front and rear web portions need not be connected by a definite fold line. In other words, the packages disclosed herein may have side edges formed by respective fold lines or the sides of the package may have U-shaped profiles, with gradual curvature rather than a vertex. Alternatively, the package could be formed by sealing rectangular front and rear panels together along four sides.

The package shown in FIGS. 1 and 2 comprises a zipper 4 that depends from the top transverse seal 12 and is further attached to the front panel 16 by a transverse band-shaped zone of joinder 30 at an elevation below the top transverse seal. The width of the zipper 4 is less than the width of the package 10, as seen in FIG. 1. As explained later, the ends of the zipper 4 are attached to the front panel along vertical band-shaped zones of joinder that are substantially orthogonal to the aforementioned transverse zone of joinder. The zipper 4 is not joined to the rear panel 18 at any elevation below the top transverse seal.

The cross-sectional structure of a suitable zipper is depicted in FIG. 2. The zipper comprises a pair of zipper parts that are mutually engageable to close the zipper and mutually disengageable to open the zipper. One zipper part comprises a base strip 22 and a female closure profile 24 comprising a pair of closure members connected to the base strip 22 and extending transversely. The other zipper part comprises a base strip 26 and a male closure profile comprising a closure member 28 connected to the base strip 26 and extending transversely. When the zipper is closed, the closure member 28 is inserted in and interlocked with the female closure profile 24. More specifically, male closure member 28 may comprise a shaft extending perpendicularly from the planar base strip 26. The shaft terminates with an enlarged head having outwardly pointing detents for engaging the female closure profile 24. The female closure element 24 comprises a pair of legs extending up from the base strip 22. The legs of the female closure element terminate in inwardly pointing detents for releasably engaging respective detents of the enlarged head of the male profile. Alternatively, the zipper parts may comprise interengageable hook-shaped closure members, interengageable ball-shaped closure members, alternative rib-and-groove designs, or any other known types of interengageable closure members.

At least a major portion of the base strip 26 is disposed between the front panel 16 and the base strip 22. Respective upper portions of the base strips 22 and 26 are joined to each other and to the receptacle in the top transverse seal 12. More specifically, the upper portion of base strip 22 is joined to an upper portion of the rear panel 18 in the top transverse seal 12, and the upper portion of base strip 26 is joined to an upper portion of the front panel 16 in the top transverse seal 12. A lower portion of the base strip 26 is joined to the front panel 16 in a transverse band-shaped zone of joinder to form a web/zipper seal 30 that extends in parallel with the transverse top and bottom seals. The web/zipper seal 30 may be formed in conventional manner, for example, by permanent heat sealing of thermoplastic materials using a heated sealing bar. As partly shown in FIG. 2, no portion of the base strip 22 is joined to the rear panel 18 outside of the top transverse seal 12.

In the embodiment shown in FIGS. 1 and 2, the opposite end portions of the base strip 26 are joined to respective confronting portions of front panel 16 and base strip 22 in respective vertical zones to provide zipper end seals 32 and 34 that intersect the top transverse seal 12 and the web/zipper seal 30. During formation of the zipper end seals 32 and 34, the closure profiles 24 and 28 are flattened. This can be accomplished by the application of sufficient heat and pressure in a process that is sometimes referred to as "thermal crushing".

Furthermore, the reclosable bag shown in FIGS. 1 and 2 is provided with frangible means for enabling the consumer to make openings in both the front panel 16 and the base strip 26, thereby allow access to the closure profiles 24 and 28. The closure profiles are in turn are disengaged from each other to allow access to the contents in the interior volume of the receptacle. The aforementioned frangible means may comprise a line of weakened tear resistance 36 (hereinafter "tear line 36") that extends transversely across a portion of the front panel 16 and a line of weakened tear resistance 38 (hereinafter "tear line 38") that extends transversely across a portion of the zipper base strip 26. The tear lines 36 and 38 (indicated by carets in FIG. 2) may be formed by conventional means. For example, each tear line may comprise a line of spaced perforations, a scoreline comprising a line of thinned material or a line of impregnation with an agent that weakens tear resistance, and so forth. In the case of the tear line 36 made in the front panel 16, that tear line may be connected at its ends to respective vertical tear lines (not shown) that extend vertically downward to form a tear line in the shape of a wide inverted U. When such a tear line is sundered, a flap of material can be folded downward to form an opening in the front panel. In accordance with a further alternative, an oval or elliptical or lozenge-shaped tear line could be provided in the front panel, allowing the portion of the front panel bounded by the tear line to be completely torn away. In the embodiment shown in FIGS. 1 and 2, the tear lines 36 and 38 are located such that the consumer may gain access to a space 40 bounded front and rear by the base strips 22 and 26 respectively and bounded top and bottom by the top transverse seal 12 and the interlocked closure profiles 24 and 28 respectively. The closure profiles can be readily disengaged from each other when the interior space 40 is accessible to the consumer.

Figure 3:
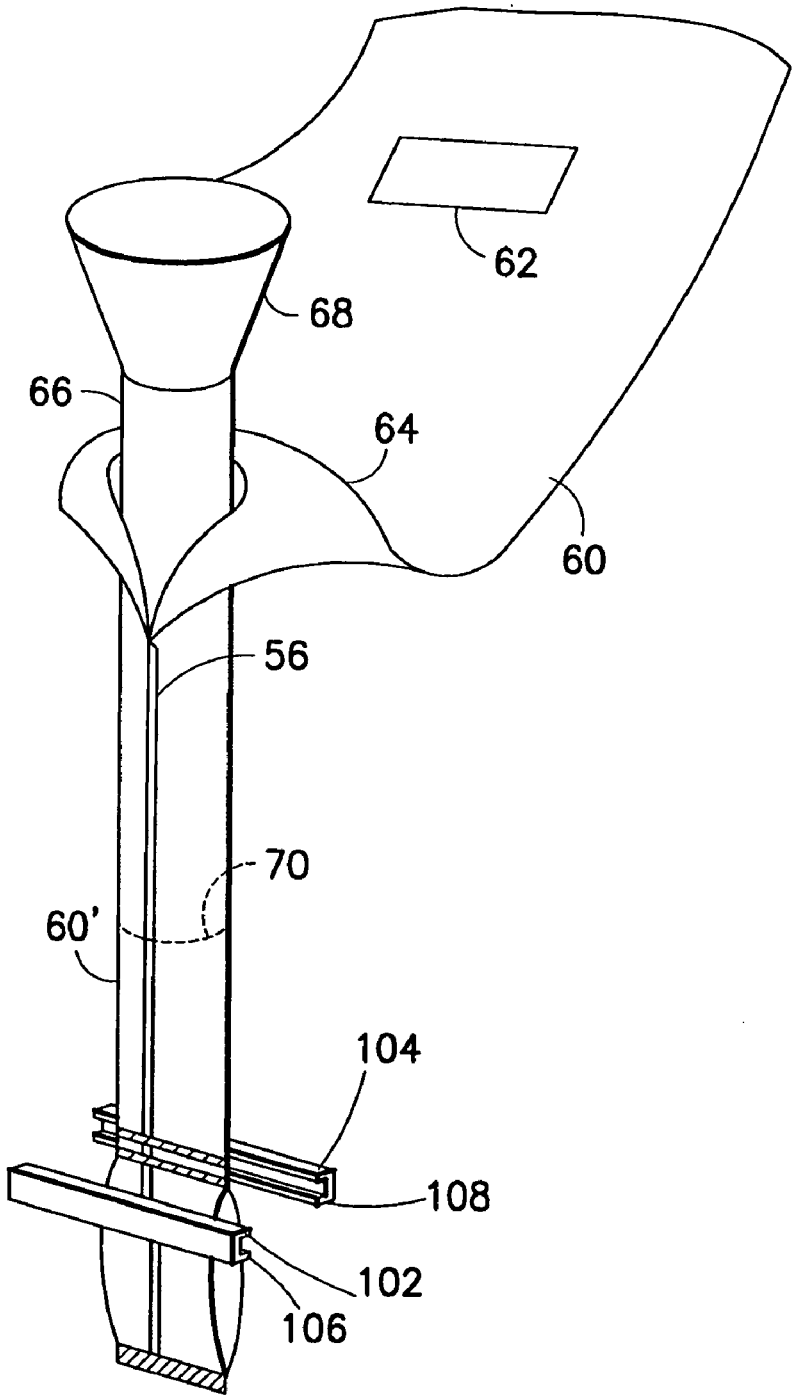
FIG. 3 is a drawing showing an isometric view of a vertical form-fill-seal (VFFS) machine for making reclosable packages in accordance with the embodiments disclosed herein.

The reclosable package depicted in FIGS. 1 and 2 can be more efficiently manufactured on a form-fill-seal (FFS) machine if double zipper constructions are used. FIG. 3 is an isometric view of a vertical form-fill-seal (VFFS) machine in accordance with one embodiment of the present invention, for making and filling reclosable packages of the type disclosed herein. The machine comprises a fill tube 66 having a funnel 68 at the top into which product is dropped. An upper portion of the fill tube 66 is partly encircled by a forming collar 64 with a gap (65 in FIG. 4) therebetween.

With the use of a VFFS machine, the print on the web of bag making film must be adjusted in order to compensate for every other bag being manufactured upside-down. As seen in FIG. 3, a web 60 of bag making film is supplied to the fill tube 66 with plastic double-zipper assemblies 62 applied at regular spaced intervals thereto. The web has printed matter thereon that is alternately right side up and upside down (see FIG. 6). The double-zipper assemblies 62 are oriented in a transverse direction to the length of web 60 and are attached to the center of the web 60. The length of each double-zipper assembly 62 is less than one half of the width of web 60 and is less than one half of the circumference of the cylinder formed by web 60 when wrapped around the fill tube 66.

Figure 5:
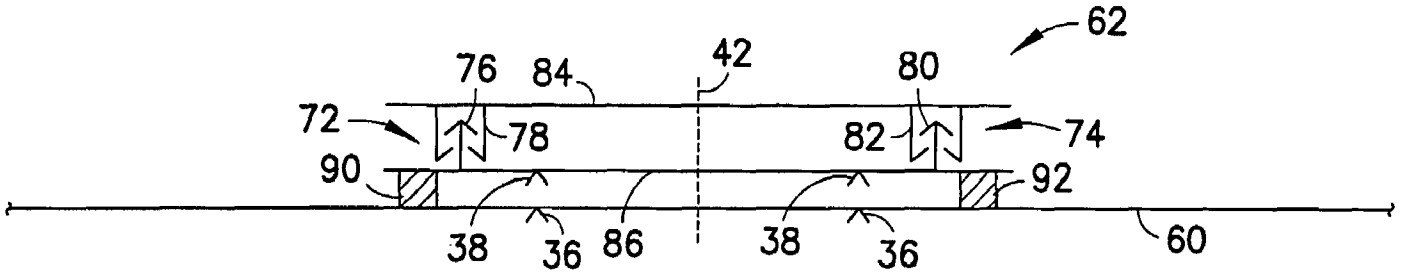
FIG. 5 is a drawing showing an end view of a double zipper attached to a web of bag making material, such double zippers being attached at regular intervals, one double zipper per two package lengths, and carried by the web through an FFS machine in order to make bags of the type depicted in FIGS. 1 and 2.
Figure 6:
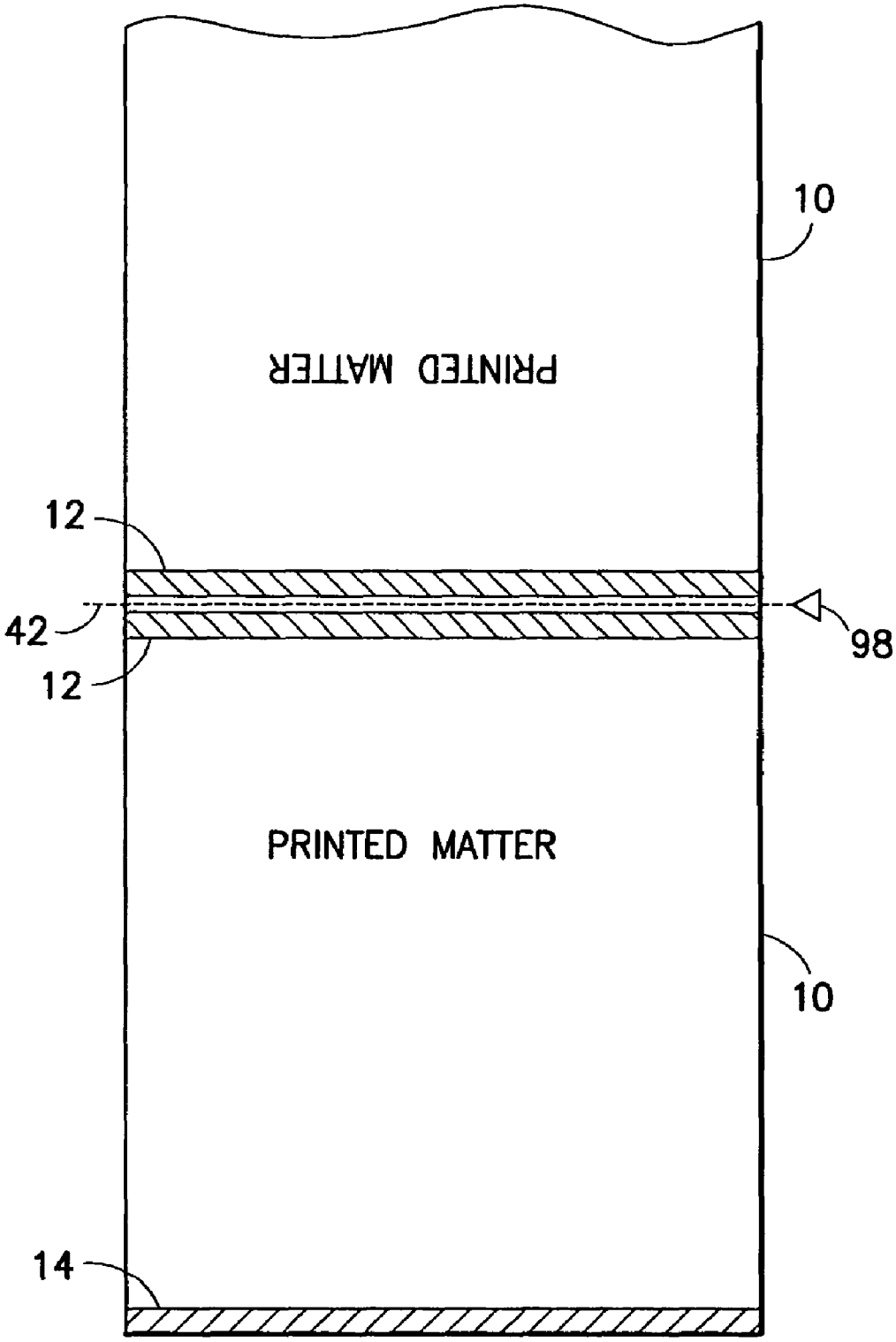
FIG. 6 is a drawing showing a front view of a distal portion of a tube of bag making material with transversely applied double zipper, with the just finished package about to be severed from the remainder of the work in process in accordance with the methods of manufacture disclosed herein. Various transverse seals are indicated by hatching.

In accordance with one method of manufacture, the double-zipper assemblies 62 are applied at spaced intervals, one double-zipper assembly per length of web needed to make two reclosable packages. As seen in FIG. 6, the printing on alternate sections of the web is reversed, each section of the web having a length equal to the web length needed to make one bag. The respective zippers of the double-zipper assembly are designed and placed for the purpose of forming the tops of two adjacent and connected reclosable packages, the lower of the two bags being right side up and the upper of the two bags being upside down. As shown in FIG. 5, each double-zipper assembly 62 straddles the boundary (located where dashed line 42 intersects web 60 in FIG. 5) between a leading web section with right-side-up printing and a trailing web section with upside-down printing.

As best seen in FIG. 5, each double-zipper assembly 62 includes two reclosable zippers 72 and 74. Dashed line 42 indicates where the double-zipper assembly will be transversely cut in two later when two bags with connected tops are severed. Zipper 72 comprises extruded closure members having complementary male and female profiles 76 and 78 respectively. Similarly, zipper 74 comprises extruded closure members having complementary male and females profiles 80 and 82 respectively. The zippers are oriented on the double-zipper assembly so that the consumer side of each zipper is facing the center of the double-zipper assembly and the product side is facing the outside edges of the double-zipper assembly. The female profiles 78 and 82 project from and are supported by a common base strip 84, while the male profiles 76 and 80 project from and are supported by a common base strip 86. Each of zipper base strips 84 and 86 is a respective strip of plastic material of constant width. In one exemplary construction, the widths of base strips 84 and 86 are equal. base strip 86 is provided with a pair of lines of weakened tear resistance, indicated by carets 38 in FIG. 5, which extend across the zipper base strip 86 parallel to the male profiles and equidistant from the center line (i.e., dashed line 42).

The web is supplied to the zipper sealing station with transverse lines of weakened tear resistance 36, which have a length less than the half-width of the web and are centrally located. The tear lines are arranged in pairs, with the midlines between the tear lines of each pair being separated by a distance equal to the length needed to make two packages. In one implementation, the distance separating the tear lines 38 in zipper base strip 86 may equal the distance separating tear lines 36 in the web. This is accomplished by placing the double zipper on top of the web with tear lines 38 approximately overlying the tear lines 36, as is depicted in FIG. 5. The double-zipper assembly 62 may be attached to the web 60 by conventional conduction heat sealing. In the example shown in FIG. 5, the zipper base strip 86 is attached to the web 60 along a pair of transverse band-shaped zones of joinder by heat sealing, forming a pair of permanent heat seals 90 and 92. The double zipper assembly 62 is also joined to the web in respective band-shaped zones of joinder that extend in parallel in the machine direction from seal 90 to seal 92, as explained in more detail below.

Typically the double-zipper assemblies 62 are attached to web 60 prior to supplying web 60 to the VFFS machine. However, the double-zipper assemblies 62 could be fastened to web 60 by a process in-line with the VFFS machine. Such an operation is taught in U.S. Pat. No. 6,151,868, which discloses that a web of thermoplastic film is paid off from a continuous roll thereof in increments equal to the length needed to form each bag being formed on the VFFS machine (hereinafter "the indexing distance"). Each time the film comes to rest, a continuous ribbon of interlocked zipper strips is paid out from a spool on which the zipper ribbon is wound. A zipper-length distal segment of the interlocked zipper strips is positioned on a central portion of the web transverse to the machine direction in which the web is intermittently advanced. The distal segment of the interlocked zipper strips is correctly positioned by a positioning device, with the base strip of one zipper strip in contact with the web and the other zipper strip interlocked with and overlying the zipper strip that contacts the web. The positioning device can take any of a variety of forms well known to those skilled in the art of manufacturing reclosable packages on FFS machines, such as a vacuum conveyor for pulling the distal segment of the zipper ribbon across the film. When the distal segment is in proper position, a knife or other cutting instrument severs the distal segment from the remainder of the zipper ribbon.

For purposes of the present invention, the method of zipper attachment disclosed in U.S. Pat. No. 6,151,868 would need to be modified to take into account the fact that the severed segment constitutes a double zipper for two reclosable packages. To attach double zippers in-line with the VFFS machine would entail the formation of two mutually parallel heat seals (seals 90 and 92 shown in FIG. 5) using two pairs of sealing bars (not shown in FIG. 5) instead of one pair, each pair of sealing bars comprising a heated bar and an unheated bar, with the heated bar being under the web and the unheated bar above the double zipper. Each heated sealing bar applies sufficient heat to cause the thermoplastic film material of the web 60 to soften or melt and then fuse to the zipper strip base strip 86 upon cooling, thereby forming respective web/zipper zones of joinder 90 and 92 along the discrete length of double zipper.

After the double zipper has been attached to the web along the transverse zones of web/zipper joinder 90 and 92, heat and pressure are applied in respective band-shaped zones 32 and 34 (seen in FIG. 1) that are oriented in the machine direction (orthogonal to the transverse zones of joinder) and connect the respective pairs of ends of the transverse zones of web/zipper joinder, thereby forming zipper end seals. Within each zipper end seal 32 and 34, the interlocked closure profiles are thermally crushed and the web 60 and zipper base strips 84 and 86 are joined together.

Figure 4:
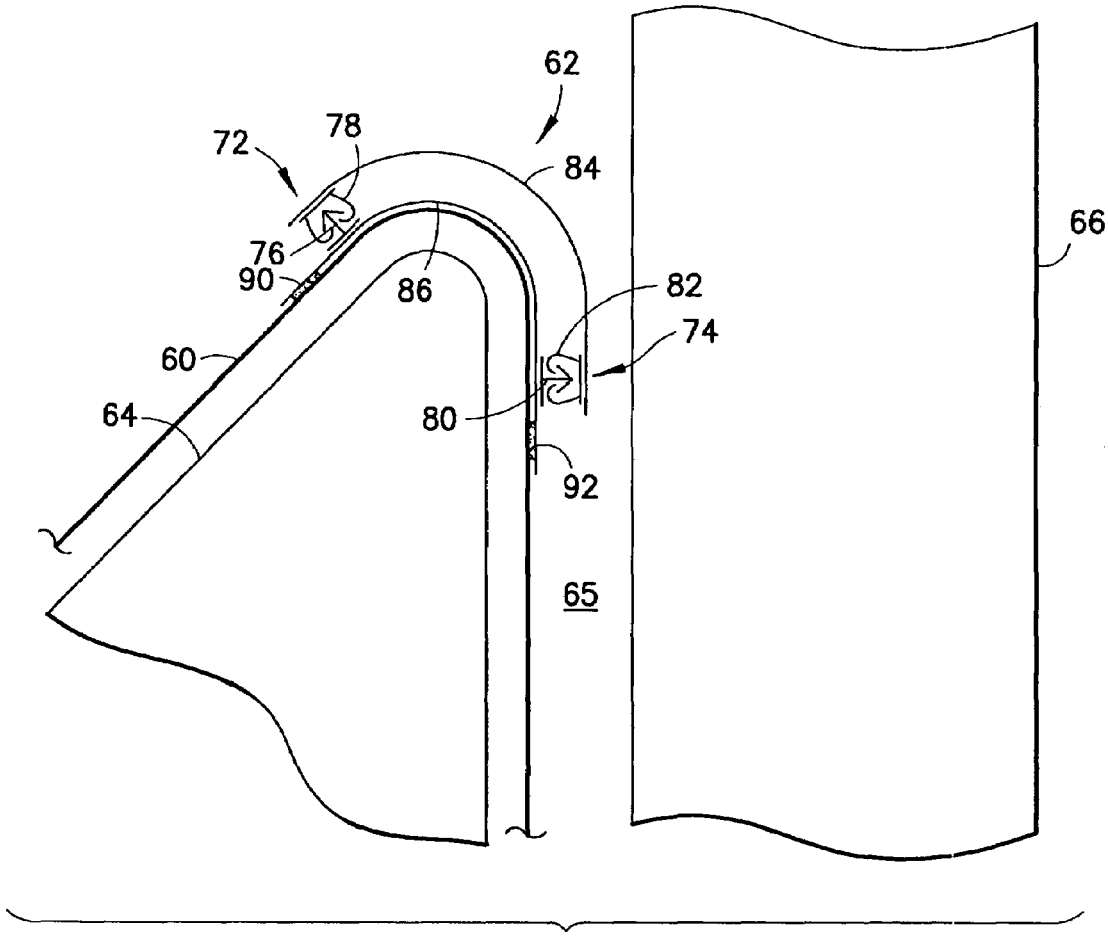
FIG. 4 is a drawing showing a fragmentary view (partially sectioned) of a web of bag making film with attached double zipper passing through the gap between the forming collar and the fill tube of the VFFS machine depicted in FIG. 3.

As seen in FIG. 4, the web 60 carries the transversely applied double-zipper assembly 62 over the crown of the forming collar 64 and into the gap 65 between the collar and the fill tube 66. Web 60 of film is drawn over the forming collar 64, through the gap between the forming collar and the fill tube 66, and around the fill tube to form a generally cylindrical shape (seen in FIG. 3). Then a vertical seam 56 (e.g., a fin seal or a lap seal) is formed by known methods, e.g., by conventional conduction heat sealing using a pair of vertical sealing bars (not shown), thereby forming a film tube 60'.

In accordance with the embodiment depicted in FIG. 3, the film tube 60' is advanced intermittently by an indexing distance that equals the length of film needed to make a single reclosable bag. As seen in FIG. 6, the printing on alternate reclosable packages coming off of the VFFS machine is reversed, e.g., in the bag just completed, the print is right side up, while in the next bag to be made, the print is upside down, and so forth. The top and bottom seals are formed during alternating work cycles, i.e., a pair of bottom seals 14 (only one of which is shown in FIG. 6) are made during odd-numbered work cycles and a pair of top seals 12 are made during even-numbered work cycles. The most recently completed package 10 is severed from the remainder of the work in process by a cutting instrument 98 during each work cycle, the line of cutting (represented by dashed line 42 in FIG. 6) being located midway between the seals of each pair of concurrently formed top or bottom seals. The seals are formed and the line 42 is cut during each dwell time between successive web advances.

In accordance with the embodiment depicted in FIG. 3, the VFFS machine comprises two pairs of mutually opposing reciprocatable web cross sealing bars 102, 104 and 106, 108. The sealing bars are located at elevations lower than the elevation of bottom 70 of the fill tube 66, and move alternately toward and away from each other during reciprocation. The cross sealing bar 102 opposes the cross sealing bar 104, while the cross sealing bar 106 opposes the cross sealing bar 108. During the dwell times of odd-numbered work cycles, these paired cross sealing bars are extended to form the bottom seals; during the dwell times of even-numbered work cycles, the paired cross sealing bars are extended to form the top seals. The latter dwell times may be longer in duration than the former dwell times to allow additional time for heat to be conducted to the interface of the zipper base strips, which must be joined to each other and to the web for top sealing.

FIG. 3 shows the cross sealing bars 102 and 106 being mechanically linked to each other, as are the cross sealing bars 104 and 108. This can be accomplished by attaching linked sealing bars to the same mounting plate, which mounting plate is in turn attached to the distal end of a piston rod of a double-acting pneumatic cylinder or other actuator for effectuating reciprocation. However, a person skilled in the art will appreciate that such mechanical linkages are not necessary to practice of the present invention. Each sealing bar could be coupled to a respective actuator, the actuators of synchronized sealing bars being controlled by the PLC to operate concurrently.

As previously mentioned, the embodiment shown in FIG. 3 further comprises a knife or other cutting instrument (not shown in FIG. 3) that separates the bottoms of two adjacent reclosable packages, thereby allowing the lowermost reclosable package (which previously has had its upper seal area formed and has been filled with product) to become free of the web and continue as a completed package. In FIG. 6, the blade of this cutting instrument is represented by triangle 98 and the transverse cut is represented by dashed line 42. The knife may be operated independently or it can be mechanically linked to one pair of the cross sealing bars, a backing in opposition to the knife being mechanically linked to the opposing pair of cross sealing bars.

The operations of the machine shown in FIG. 3 are controlled in accordance with a predetermined routine dictated by a programmed logic controller. A pair of cross seals are made and the pocket above the upper cross seal so formed is filled with product during the dwell time of each work cycle. To make bags one at a time, the cutting instrument is controlled to make a transverse cut at the end of each (odd-numbered and even-numbered) work cycle. To make saddle-bags (i.e., pairs of bags connected at their tops), the cutting instrument is controlled to make a transverse cut at the end of odd-numbered work cycles only.

It is not necessary that the cross sealing bars consist of spaced-apart sealing bars. A single set of wider sealing bars could be used provided that the transverse cutting instrument were designed to cut in a subsequent operation instead of concurrently.

The film tube can be advanced (downwardly) by any conventional means, such as drive belts (not shown) that bear against the film wrapped around the fill tube. To implement indexing of the film tube using drive belts, for each drive belt a gearbelt pulley is mounted to the end of the shaft of one of the belt rollers. The pulley is driven by a gearbelt, causing the roller to rotate. A programmable controller (not shown) controls a servomotor, which in turn drives the pulley, causing the roller to rotate to the extent needed to advance the film tube by the indexing distance.

With regard to the set of mutually opposing cross sealing bars, at least one of the sealing bars of each set must be heated. The temperature of each heated sealing bar is controlled by a programmable heat controller (not shown). The dwell time of each heated sealing bar in the extended position is controlled by the PLC.

Hydraulic cylinders can be employed in place of air, i.e., pneumatic, cylinders. A person skilled in the art of machinery design will readily appreciate that displacing means other than a cylinder can be used to displace the reciprocatable sealing bars. For the sake of illustration, such mechanical displacement devices include rack and pinion arrangements, rotation of the pinion being driven by an electric motor.

Figure 7:
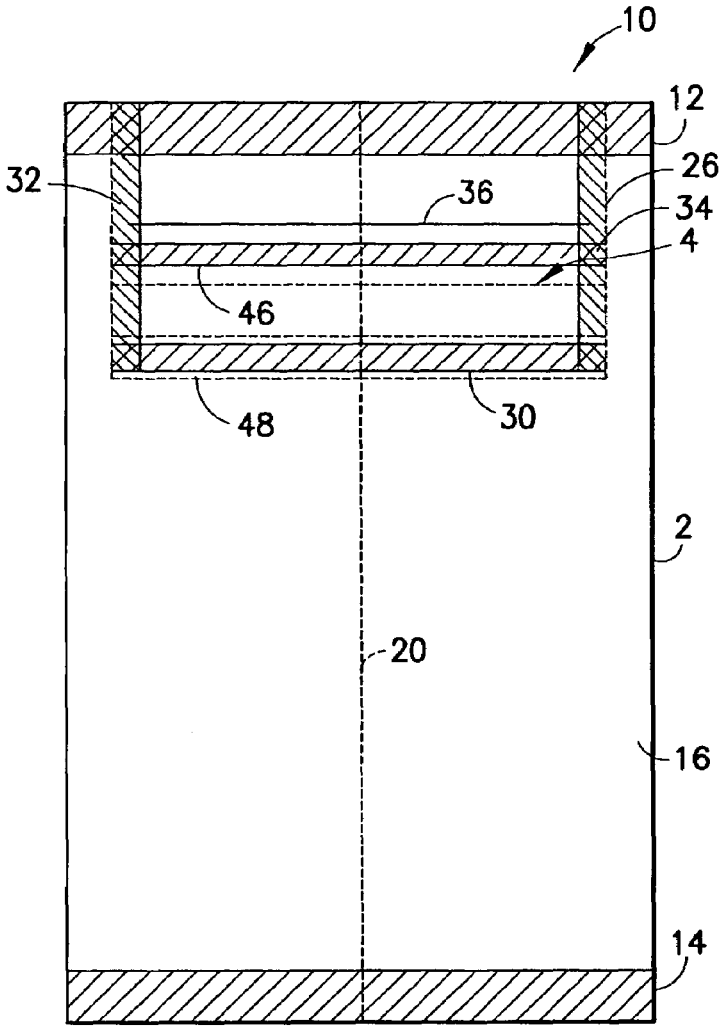
FIG. 7 is a drawing showing a front view of a reclosable package in accordance with a second embodiment of the invention. Transverse seals, peel seals and zones of web/zipper joinder are indicated by hatching.
Figure 8:
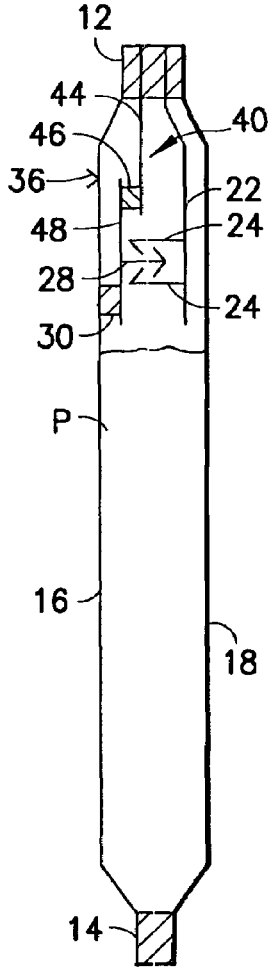
FIG. 8 is a drawing showing a sectional view of the reclosable package depicted in FIG. 7.

A reclosable package in accordance with a second embodiment of the invention is shown in FIGS. 7 and 8. The second embodiment differs from the first in that the line of weakened tear resistance in the front base strip of the zipper in the package shown in FIG. 2 has been replaced by a peel seal. As seen in FIG. 8, the peel seal 46 is situated between and joined to overlapping marginal portions of two base strips 44 and 48. The base strip 44 depends from the top transverse seal 12 and does not have a closure profile connected thereto. The base strip 48 is attached to the front panel 16 by a transverse band-shaped zone of joinder 30 at an elevation below the top transverse seal and has closure profile 28 connected thereto. As seen in FIG. 8, this zipper assembly is not joined to the rear panel 18 at any elevation below the top transverse seal.

The peel seal 46 may comprise a strip of conventional peel seal material that extends approximately parallel to the closure profiles 24 and 28. The peel seal material may be peeled apart to unseal the package, allowing the consumer to access the interior space above the closure profiles and then disengage the closure profiles to open the zipper. Before the consumer can gain access to the peel seal, however, the front panel 16 must be torn open along the tear line 36. Other components are structurally and functionally similar, if not identical, to the components designated by the same reference numerals in FIGS. 1 and 2.

Packages of the type shown in FIGS. 7 and 8 can be manufactured on an FFS machine using substantially the same method previously described, to wit, transversely applying double-zipper assemblies to a web (at spaced intervals therealong), which is then advanced intermittently in a machine direction through the FFS machine. As previously described with reference to FIG. 6, the printing on alternate sections of the web is reversed, each section of the web having a length equal to the web length needed to make one bag. The respective zippers of the double-zipper assembly are designed and placed for the purpose of forming the tops of two adjacent and connected reclosable packages, the lower of the two bags being right side up and the upper of the two bags being upside down.

Figure 9:
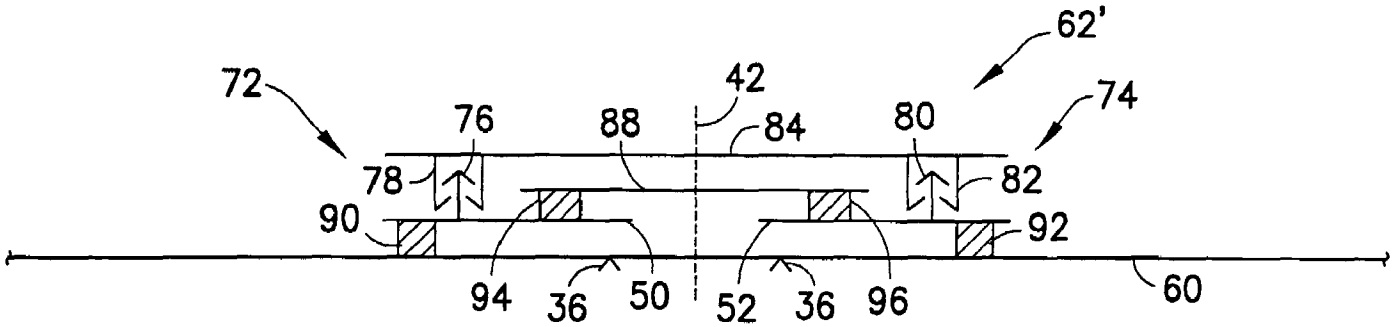
FIG. 9 is a drawing showing an end view of a double zipper assembly attached to a web of bag making material, such double zipper assemblies being attached at regular intervals, one double zipper assembly per two package lengths, and carried by the web through an FFS machine in order to make bags of the type depicted in FIGS. 7 and 8.

FIG. 9 shows a sectional view of a double-zipper assembly 62' having two peel seals 94 and 96, which assembly has been transversely applied to a central portion of a web 60. The web 60 is again supplied to the zipper sealing station with transverse lines of weakened tear resistance 36, as previously described. The double-zipper assembly 62' will later be cut along line 42 to form zipper assemblies of the type incorporated in the package shown in FIGS. 7 and 8.

Still referring to FIG. 9, each double-zipper assembly 62' includes two reclosable zippers 72 and 74. Dashed line 42 indicates where the double-zipper assembly will be transversely cut in two. Zipper 72 comprises extruded closure members having complementary male and females profiles 76 and 78 respectively. Similarly, zipper 74 comprises extruded closure members having complementary male and females profiles 80 and 82 respectively. The females profiles 78 and 82 project from and are supported by a common base strip 84, while the male profiles 76 and 80 project from and are supported by respective base strips 50 and 52. Each of base strips 50, 52 and 88 is a respective strip of plastic material of constant width. Base strip 50 has a first transverse section joined to the web 60 along a transverse band-shaped zone 90 and a second transverse section joined to the peel seal material of peel seal 94; base strip 52 has a first transverse section joined to the web 60 along a transverse band-shaped zone 92 and a second transverse section joined to the peel seal material of peel seal 96. The base strip 88 has respective sections joined to and an intermediate section that spans the space between the strips of peel seal material 94 and 96. Respective portions of this intermediate section of base strip 88 will later be incorporated in the top transverse seals of respective bags, as seen in FIG. 8.

In a VFFS implementation, the web 60 carries each attached double-zipper assembly as the web is advanced through a VFFS machine, with the forming, filling and sealing operations being carried out in the same manner previously described. However, packages similar to those shown in FIGS. 1 and 7 can be manufactured on a horizontal flow wrapper or a pouching machine.

While the invention has been described with reference to certain embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc. As used in the claims, the term "panel" means a single continuous wall or a wall comprised of two or more sections joined together (e.g., by means of a fin seal or lap seal). Furthermore, in the absence of explicit language in any method claim setting forth the order in which certain steps should be performed, the method claims should not be construed to require that steps be performed in the order in which they are recited.

The invention claimed is:

1. A reclosable package comprising:

a sealed receptacle having an interior volume and comprising a top transverse seal, a bottom transverse seal, a front panel extending between said top and bottom transverse seals, and a rear panel connected to said front panel at opposing sides of said receptacle and extending between said top and bottom transverse seals;

a mass of product occupying a portion of said interior volume of said receptacle;

a zipper comprising first and second zipper parts that are mutually engageable to close said zipper and mutually disengageable to open said zipper, said first zipper part comprising a first closure member and a first base strip connected to said first closure member, and said second zipper part comprising a second closure member in engagement with said first closure member and a second base strip connected to said second closure member, said second base strip having a height greater than the height of said first base strip, at least a portion of said first base strip being disposed between said front panel and said second base strip; and a third base strip disposed between said front panel and said second base strip, a lower portion of said third base strip being joined to an upper portion of said first base strip by a transverse peel seal, wherein respective upper portions of said second and third base strips are joined to each other and to said receptacle in said top transverse seal, a lower portion of said first base strip is joined to said front panel in a transverse band-shaped zone of joinder, and no portion of said second base strip is joined to said rear panel outside of said top transverse seal.

2. The reclosable package as recited in claim 1, further comprising a vertical seal on said rear panel.

3. The reclosable package as recited in claim 1, wherein said front, panel comprises a transverse line of weakened tear resistance disposed between said top and bottom transverse seals.

* * * * *